US009400469B2

(12) United States Patent
Nakai

(10) Patent No.: US 9,400,469 B2
(45) Date of Patent: Jul. 26, 2016

(54) IMAGE FORMING APPARATUS AND METHOD OF WARNING LIFE OF CHARGING ROLLER IN IMAGE FORMING APPARATUS

(71) Applicant: KYOCERA Document Solutions Inc., Osaka (JP)

(72) Inventor: Jun Nakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/739,747

(22) Filed: Jun. 15, 2015

(65) Prior Publication Data

US 2015/0370207 A1 Dec. 24, 2015

(30) Foreign Application Priority Data

Jun. 23, 2014 (JP) ..... 2014-128165

(51) Int. Cl.
*G03G 15/00* (2006.01)
*G03G 21/20* (2006.01)
*G03G 15/02* (2006.01)

(52) U.S. Cl.
CPC ..... *G03G 15/553* (2013.01); *G03G 15/0216* (2013.01); *G03G 15/502* (2013.01); *G03G 21/20* (2013.01)

(58) Field of Classification Search
CPC ..... G03G 15/553; G03G 21/20
See application file for complete search history.

(56) References Cited

U.S. PATENT DOCUMENTS

2007/0269234 A1* 11/2007 Kurita ..... G03G 15/0225 399/111
2010/0247122 A1* 9/2010 Hagiwara ..... G03G 21/203 399/44
2010/0278549 A1* 11/2010 Ishibashi ..... G03G 15/0266 399/50

FOREIGN PATENT DOCUMENTS

JP 2000-338749 A 12/2000

* cited by examiner

*Primary Examiner* — Ryan Walsh
(74) *Attorney, Agent, or Firm* — Studebaker & Brackett PC

(57) ABSTRACT

An image forming apparatus includes a charging roller, a temperature sensor, a humidity sensor, a sampling part, a life consumption degree calculating part and a warning processing part. The sampling part executes temperature/humidity inputting process inputting temperature of the temperature sensor and humidity of the humidity sensor. The life consumption degree calculating part calculates a life consumption degree of the charging roller from a last time to a present time in the temperature/humidity inputting process by applying respective representative values of last and present inputted temperature and humidity into a model formula. The warning processing part outputs a warning when an addition value of the life consumption degrees exceeds a predetermined threshold value. The life consumption degree calculating part uses the model formula deriving larger life consumption degree in a case where the representative value of the temperature and the representative value of the humidity are respectively larger.

9 Claims, 4 Drawing Sheets

IMAGE FORMING APPARATUS AND METHOD OF WARNING LIFE OF CHARGING ROLLER IN IMAGE FORMING APPARATUS

INCORPORATION BY REFERENCE

This application is based on and claims the benefit of priority from Japanese Patent application No. 2014-128165 filed on Jun. 23, 2014, the entire contents of which are incorporated herein by reference.

BACKGROUND

The present disclosure relates to an image forming apparatus and a method of warning a life of a charging roller in the image forming apparatus.

Generally, an image forming apparatus of an electrographic type includes a charging roller facing to a rotatable image carrier and rotating to electrically charge the image carrier by rotating. The charging roller has a core metal part and an elastic part, such as electrical conductive rubber, formed at a side of an outer circumference face of the core metal part.

It is known that constant voltage is applied or constant current is fed to a circuit including the core metal part of the charging roller and electric resistance of the charging roller is calculated from measured value of current or voltage in the circuit.

Incidentally, if the charging roller is used for long time, it is feared that the core metal part is corroded. As temperature and humidity in using environment of the charging roller are higher, speed of advance of corrosion of the core metal part is accelerated. If the corrosion of the core metal part is advanced, dispersion of charging property in the elastic part occurs and exerts a bad influence on image quality.

That is, a lifetime of the charging roller is varied according to a condition of the using environment of the charging roller. The lifetime of the charging roller is a period during which the charging roller can be used without causing the bad influence on the image quality due to the corrosion of the core metal part. Therefore, it is important to estimate the lifetime of the charging roller and to output a warning urging maintenance, such as replacement of the charging roller, before using time reaches the lifetime.

Generally, as the corrosion of the core metal part is advanced, the electric resistance of the charging roller is increased. Therefore, it is known that constant voltage is applied or constant current is fed to the circuit including the core metal part of the charging roller and the electric resistance of the charging roller is calculated from measured value of current or voltage in the circuit to grasp corrosion condition of the core metal part on the basis of the electric resistance.

However, in a case where the corrosion is caused partly in the core metal part, because variation of the electric resistance of the charging roller is extremely small, it is difficult to detect extremely small variation of the resistance. Therefore, it is difficult to estimate in advance the lifetime of the charging roller from the variation of the electric resistance of the charging roller.

SUMMARY

In accordance with an embodiment of the present disclosure, an image forming apparatus includes a charging roller, a temperature sensor, a humidity sensor, a sampling part, a life consumption degree calculating part and a warning processing part. The charging roller electrically charges an image carrier. The temperature sensor detects temperature in an environment of the charging roller. The humidity sensor detects humidity in the environment of the charging roller. The sampling part executes temperature and humidity inputting process inputting detected temperature of the temperature sensor and detected humidity of the humidity sensor at a predetermined timing. The life consumption degree calculating part calculates a life consumption degree of the charging roller per a period from a last executing point to a present executing point in the temperature and humidity inputting process by applying respective representative values of last and present inputted detected temperature and detected humidity into a predetermined model formula every time the temperature and humidity inputting process is executed. The warning processing part outputs a warning in a case where an addition value of the life consumption degrees exceeds a predetermined threshold value. The life consumption degree calculating part uses, as the model formula, an expression deriving larger life consumption degree in a case where the representative value of the detected temperature and the representative value of the detected humidity are respectively larger, as compared with a case where they are smaller.

In accordance with another embodiment of the present disclosure, a method of warning a life of a charging roller in an image forming apparatus includes a sampling step, a life consumption degree calculating step and a warning processing step. The sampling step executes temperature and humidity inputting process inputting detected temperature and detected humidity in an environment of the charging roller at a predetermined timing. The life consumption degree calculating step calculates a life consumption degree of the charging roller per a period from a last executing point to a present executing point in the temperature and humidity inputting process by applying respective representative values of last and present inputted detected temperature and detected humidity into a predetermined model formula every time the temperature and humidity inputting process is executed. The warning processing step outputs a warning in a case where an addition value of the life consumption degrees exceeds a predetermined threshold value. The life consumption degree calculating step uses, as the model formula, an expression deriving larger life consumption degree in a case where the representative value of the detected temperature and the representative value of the detected humidity are respectively larger, as compared with a case where they are smaller.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, an embodiment of the present disclosure will be described with reference to the accompanying drawings. Incidentally, the following embodiment is an example of actualization of the disclosure and does not restrict technical scope of the disclosure.

<Configuration of Image Forming Apparatus>

Figure 1:
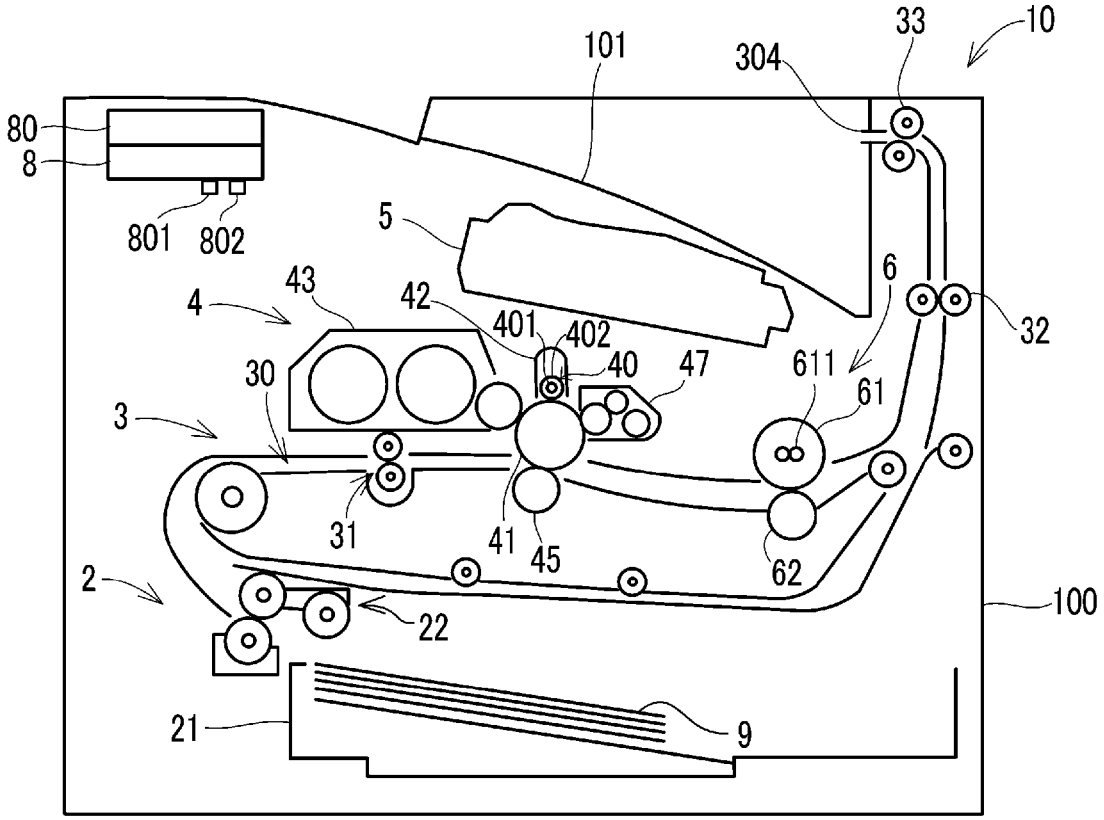
FIG. 1 is a sectional view schematically showing structure of an image forming apparatus according to an embodiment of the present disclosure.

Firstly, with reference to FIGS. 1 and 2, structure of an image forming apparatus 10 according to the embodiment of the present disclosure will be described. The image forming apparatus 10 is an image forming apparatus of an electrographic type. As shown in FIG. 1, the image forming apparatus 10 includes a sheet feeding part 2, a sheet conveying part 3, an image forming part 4, an optical scanning part 5, a fixing device 6, a temperature sensor 801, a humidity sensor 802, a controlling part 8, an operating/displaying part 80 and others in a housing 100.

Incidentally, the image forming apparatus 10 is, for example, a printer, a copying machine, a facsimile, a multifunction peripheral or the like. The multifunction peripheral has a function of the printer, a function of the copying machine and others.

The sheet feeding part 2 includes a sheet reception part 21 and a sheet sending part 22. The sheet reception part 21 is configured so that a plurality of recording sheets 9 can be superposed and placed. The recording sheet 9 is a sheet like image formed medium, such as a paper, a coated paper, a post card, an envelope, an OHP (OverHead Projector) sheet.

The sheet sending part 22 sends the recording sheet 9 from the sheet reception part 21 to a conveying path 30 by coming into contact with the recording sheet 9 and rotating.

The sheet conveying part 3 includes a paper stop roller 31, a conveying roller 32, an ejecting roller 33 and others. The paper stop roller 31 and the conveying roller 32 convey the recording sheet 9 fed from the sheet feeding part 2 toward the image forming part 4. Further, the ejecting roller 33 ejects the recording sheet 9 after image forming from an ejecting port 304 of the conveying path 30 onto an ejection tray 101.

The image forming part 4 forms an image onto a surface of the recording sheet 9 while the recording sheet 9 fed from the sheet sending part 22 is moving in the conveying path 30. The image forming part 4 includes a drum like photoreceptor 41, a charging part 42, a developing part 43, a transferring part 45, a cleaning part 47 and others. The charging part 42 includes a charging roller 40. The charging part 42 is an example of an image carrier.

The photoreceptor 41 is rotated and the charging part 42 electrically charges evenly a surface of the photoreceptor 41. In the charging part 42, the charging roller 40 electrically charges the photoreceptor 41 by facing to the photoreceptor 41 and rotating. The charging roller 40 has a core metal part 401 and an elastic part 402, such as electrical conductive rubber, formed at a side of an outer circumference face of the core metal part 401.

The core metal part 401 has, for example, a base part made of metal, such as carbon steel alloy, and an outer cover part, such as electroless nickel planting, formed on a surface of the base part. The outer cover part is formed, for example, in a thickness of a degree of 3-15 micrometers. The elastic part 402 is, for example, a member of electrical conductive rubber, such as epichlorohydrin rubber. The elastic part 402 is adhered onto the outer circumference face of the core metal part 401.

The optical scanning part 5 writes an electrostatic latent image onto the photoreceptor 41 by irradiating with a laser light. The developing part 43 develops the electrostatic latent image by supplying a developer to the photoreceptor 41. The transferring part 45 transfers the image (the developer) on the surface of the photoreceptor 41 onto the recording sheet 9 moving in the conveying path 30. Finally, the cleaning part 47 removes the developer remained on the surface of the photoreceptor 41.

In the fixing device 6, a heating roller 61 having a heater 611 built-in and a pressuring roller 62 facing to it sandwich the recording sheet 9, onto which the image is formed, between them and send it to a following step. Thereby, the fixing device 6 heats the developer on the recording sheet 9 and fixes the image on the recording sheet 9.

The temperature sensor 801 and the humidity sensor 802 are sensors measuring temperature and humidity in environment where the image forming part 4 (the charging roller 40) is arranged in. The temperature sensor 801 and the humidity sensor 802 are arranged at a position inside the housing 100 or along the housing 100.

For example, the temperature sensor 801 and the humidity sensor 802 are attached at a position of the controlling part 8 or at a position in its periphery. Alternatively, the temperature sensor 801 and the humidity sensor 802 may be arranged at a position closer to the photoreceptor 41.

The temperature sensor 801 is, for example, a thermistor or the like. The humidity sensor 802 is, for example, a high polymer capacitance type humidity sensor, a high polymer resistance type humidity sensor or the like. Alternatively, a temperature and humidity sensor configured by unifying the temperature sensor 801 and the humidity sensor 802 may be applied.

Figure 2:
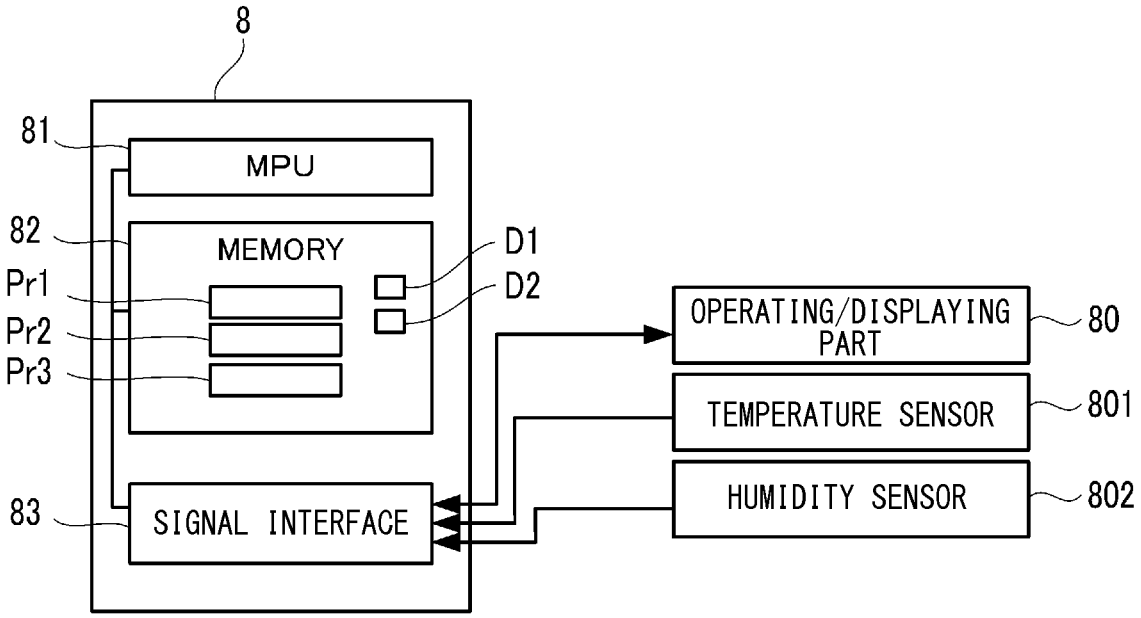
FIG. 2 is a block diagram showing components related to process warning a life of a charging roller in the image forming apparatus according to the embodiment of the present disclosure.

As shown in FIG. 2, the controlling part 8 includes a microprocessor unit (MPU) 81, a memory 82, a signal interface 83 and others.

The MPU 81 is a processor executing various operating processes. For example, the MPU 81 executes a charging roller life warning process estimating a lifetime of the charging roller 40 and outputting a warning urging maintenance of the charging roller 40 before using time reaches the lifetime. The memory 82 is a non-volatility storing part storing in advance information, such as programs Pr1-Pr3 (computer programs) making the MPU 81 execute various processes. Further, the memory 82 is also a rewritable storing part configured so that the MPU 81 can record and update various data D1 and D2.

The controlling part 8 integrally controls the image forming apparatus 10 by making the MPU 81 execute various programs Pr1-Pr3 stored in advance in the memory 82.

The signal interface 83 is an inter face circuit relaying delivery of a signal between the MPU 81 and the sensor or a control object device. Into the MPU 81, detected signals (measured signals) of the temperature sensor 801, the humidity sensor 802 and another sensor are inputted via the signal interface 83.

In the following description, the temperature and the humidity inputted from the temperature sensor 801 and the humidity sensor 802 into the MPU 81 via the signal interface 83 are respectively called as environment temperature and environment humidity.

Further, the MPU 81 makes, for example, the operating/displaying part 80 including liquid crystal panel, operating buttons and others display information indicating an operation menu and a state of the apparatus and others. The MPU 81 carries out delivery of information with the operating/displaying part 80 via the signal interface 83.

Incidentally, if the charging roller 40 is used for long time, it is feared that the core metal part 401 is corroded. In addition, as temperature and humidity in using environment of the charging roller 40 are higher, speed of advance of corrosion of the core metal part 401 is accelerated. If the corrosion of the core metal part 401 is advanced, dispersion of charging property in the elastic part 402 occurs and exerts a bad influence on image quality.

That is, the lifetime of the charging roller 40 is varied according to a condition of the using environment of the charging roller 40. The lifetime of the charging roller 40 is a period during which the charging roller 40 can be used without causing the bad influence on the image quality due to the corrosion of the core metal part 401. Therefore, it is important to estimate the lifetime of the charging roller 40 and to output the warning urging the maintenance of the charging roller, before using time reaches the lifetime.

Generally, as the corrosion of the core metal part 401 is advanced, electric resistance of the charging roller 40 is increased. Therefore, it is considered that constant voltage is applied or constant current is fed to a circuit including the core metal part 401 of the charging roller 40 and the electric resistance of the charging roller 40 is calculated from measured value of current or voltage in the circuit to grasp corrosion condition of the core metal part 401 on the basis of the electric resistance.

However, in a case where the corrosion is caused partly in the core metal part 401, because variation of the electric resistance of the charging roller 40 is extremely small, it is difficult to detect extremely small variation of the resistance. Therefore, it is difficult to estimate in advance the lifetime of the charging roller 40 from the variation of the electric resistance of the charging roller 40.

By contrast, in the image forming apparatus, the MPU 81 executes a charging roller life warning process. Thereby, it is possible to output the warning before the using time of the charging roller 40 reaches the lifetime varying according to the environment temperature and the environment humidity.

<Description of a Manner of Estimating the Life Time of the Charging Roller 40>

Here, before description of a method of warning the life of the charging roller, a manner of estimating the life time of the charging roller 40 will be described.

The corrosion of the core metal part 401 is a chemical reaction. Generally, among a reaction rate constant k, a substance amount V per unit volume and a reaction order n, relationship of the following numerical expression (1) is established. The numerical expression (1) indicates that a reducing speed of the substance amount due to the chemical reaction (the corrosion) is in proportion to n-th power of the substance amount before the chemical reaction.

$$\frac{dV}{dt} = -kV^n \tag{1}$$

On the other hand, the reaction rate constant k depends on the environment temperature T (absolute temperature) and the environment humidity RH (relative humidity). For example, the reaction rate constant k can be indicated by the following numerical expression (2). The numerical expression (2) is an expression according to Eyring model applying the relative humidity of the environment as a stress factor into Arrhenius model.

$$k = A \cdot \exp\left(-\frac{E}{k_b T}\right) \cdot f(RH) \tag{2}$$

The numerical expression (2) has activation energy E, Boltzmann's constant $k_b$, a constant A specific to a substance, the environment temperature T (the absolute temperature) and a function f(RH) of the environment humidity RH (the relative humidity). The function f(RH) is a function indicating contribution of the humidity RH to the reaction rate constant k. Because the chemical reaction (the corrosion) is accelerated as the humidity RH is higher, for example, the function f(RH) may be indicated by the following numerical expression (3). Incidentally, the expression (3) has the humidity RH and a constant B.

$$f(\mathrm{RH}) = \exp(-B/\mathrm{RH}) \tag{3}$$

The expression (3) is a general expression indicating a positive interrelation between the reaction rate constant k and the humidity RH, but an approximate function obtained by experimentation may be applied to the function f(RH).

For example, assuming that the reaction order n in the corrosion of the core metal part 401 made of metal, such as carbon steel alloy, is 1, a case where the substance amount V of the core metal part 401 is reduced due to oxidation (the corrosion) of the core metal part 401 is considered. In this case, the expression (1) is replaced with the following numerical expression (4).

$$\frac{dV}{dt} = -kV \tag{4}$$

The following numerical expression (5) is an expression obtained by integrating both sides of the expression (4). The expression (5) has an early substance volume $V_0$, a substance volume $V_e$ when reaching the lifetime and the lifetime $t_e$ about the core metal part 401. The substance volume $V_e$ when reaching the lifetime is a substance volume of the core metal part 401 when the core metal part 401 becomes a state regarded as reaching the life time due to the corrosion. The lifetime $t_e$ is a time required until the substance volume of the core metal part 401 comes from the early substance volume $V_0$ to the substance volume $V_e$ when reaching the lifetime.

$$\int_{V_0}^{V_e} \frac{1}{V} dV = \int_0^{t_e} -k dt \tag{5}$$

By substituting the expression (2) for the expression (5), the following numerical expression (6) is obtained.

$$\int_{V_0}^{V_e} \frac{1}{V} dV = -\int_0^{t_e} A \cdot \exp\left(-\frac{E}{k_b T}\right) \cdot \exp\left(-\frac{B}{RH}\right) dt \tag{6}$$

Assuming the environment temperature T is constant, the expression (6) is expressed by the following numerical expression (7).

$$\ln\left(\frac{V_e}{V_0}\right) = -At_e\exp\left(-\frac{E}{k_bT}\right)\exp\left(-\frac{B}{RH}\right) \tag{7}$$

Since, in the expression (7), $V_0 > V_e$ is established, the expression (7) may be rewritten to the following numerical expression (8).

$$\ln\left(\frac{V_0}{V_e}\right) = At_e\exp\left(-\frac{E}{k_bT}\right)\exp\left(-\frac{B}{RH}\right) \tag{8}$$

By calculating logarithms of both sides in the expression (8), the following numerical expression (9) is obtained.

$$\ln\left(\frac{1}{A}\ln\left(\frac{V_0}{V_e}\right)\right) = \ln(t_e) - \frac{E}{k_bT} - \frac{B}{RH} \tag{9}$$

The expression (9) is equivalent to the following numerical expression (10).

$$\ln(t_e) = \frac{E}{k_bT} + \frac{B}{RH} + \ln\left(\frac{1}{A}\ln\left(\frac{V_0}{V_e}\right)\right) \tag{10}$$

The expression (10) indicates the following fact. That is, in an environment where the environment humidity RH is constant, a logarithmic value of the lifetime $t_e$ is simply increased linearly according to increasing of a reciprocal of the environment temperature T. Similarly, in an environment where the environment temperature T is constant, the logarithmic value of the lifetime $t_e$ is simply increased linearly according to increasing of a reciprocal of the environment humidity RH.

In addition, as long as the early substance volume $V_0$ and the substance volume $V_e$ when reaching the lifetime as prerequisites for lifetime estimation are constant, a third term in a right side of the expression (10) is constant. Therefore, it is deemed that the right side of the expression (10) is a primary linear polynomial expression having two variables of the reciprocal of the environment temperature T and the reciprocal of the environment humidity RH. That is, the right side of the expression (10) is an expression indicating one plane having two variables of the reciprocal of the environment temperature T and the reciprocal of the environment humidity RH.

Generally, it is often difficult to measure directly the constant A, the constant B, the activation energy E, the early substance volume $V_0$ and the substance volume $V_e$. Therefore, the expression (10) may be partly replaced with constants α, β, γ and rewritten to the following numerical expression (11).

$$\ln(t_e) = \frac{\alpha}{T} + \frac{B}{RH} + \gamma \tag{11}$$

The constants α, β, γ in the expression (11) are constants determined experimentally on the basis of results of a plurality of corrosion experiments with different conditions of the environment temperature and the environment humidity. In a case where the environment temperature T (the absolute temperature) and the environment humidity RH (the relative humidity) are not varied, the lifetime $t_e$ of the charging roller 40 may be calculated (estimated) on the basis of the expression (11). Incidentally, it is deemed that a right side of the expression (11) is a primary linear polynomial expression having two variables of the reciprocal of the environment temperature T and the reciprocal of the environment humidity RH.

Next, a case where the environment temperature and/or the environment humidity are varied will be described. For example, it may be regarded that a period from an initial state to the lifetime is a set of n factor periods divided for respective time series. Here, assuming that elapsed times from a starting point to the respective end points of the time series are $t_1$, $t_2$, $t_3 \ldots t_n$.

Here, it may be regarded that an environment where the environment temperature and/or the environment humidity are varied stepwisely for each factor period is approximate to an actual environment from the initial state to the lifetime. Thereupon, assuming that the respective environment temperatures (the absolute temperatures) of the factor periods are $T_1$, $T_2$, $T_3 \ldots T_n$. Moreover, assuming that the respective environment humidities (the relative humidities) of the factor periods are $RH_1$, $RH_2$, $RH_3 \ldots RH_n$.

The reaction rate constant $k_i$ in i-th factor period is indicated by the following numerical expression (12) obtained by applying the expression (3) to the expression (2). Incidentally, i is a natural number of n or less.

$$k_i = A\cdot\exp\left(-\frac{E}{k_bT_1}\right)\cdot\exp\left(-\frac{B}{RH_i}\right) \tag{12}$$

A right side of the expression (5) may be replaced with an integration expression of variations of the respective substances amount in the factor periods. Therefore, the expression (5) may be rewritten to the following numerical expression (13).

$$\int_{V_0}^{V_e}\frac{1}{V}\,dV = -\left[\int_0^{t_1}k_1\,dt + \int_{t_3}^{t_2}k_2\,dt + \ldots + \int_{t_{n-3}}^{t_n}k_n\,dt\right] \tag{13}$$

Since $k_i$ of respective integration terms of a right side in the expression (13) are the reaction rate constants under the environment temperature and the environment humidity being constant, the expression (13) may be rewritten to the following numerical expression (14).

$$\ln\left(\frac{V_0}{V_e}\right) = At_1k_1 + A(t_2 - t_1)k_2 + \ldots + A(t_n - t_{n-1})k_n \tag{14}$$

In a case where the reaction rate constant $k_i$ is constant, i.e. a case where the environment temperature and the environment humidity is constant, if assuming that the lifetime is $t_{ei}$, the following numerical expression (15) is established.

$$\ln\left(\frac{V_0}{V_e}\right) = At_{e1}k_1 = At_{e2}k_2 = \ldots = At_{en}k_n \tag{15}$$

Therefore, the expression (14) may be rewritten to the following numerical expression (16).

$$1 = \frac{At_1k_1 + A(t_2 - t_1)k_2 + \ldots + A(t_n - t_{n-1})k_n}{\ln\left(\frac{V_0}{V_e}\right)} \quad (16)$$

If the expression (15) is applied to the expression (16), the following numerical expression (16) is obtained.

$$1 = \frac{At_1k_1}{At_{e1}k_1} + \frac{A(t_2 - t_1)k_2}{At_{e2}k_2} + \ldots + \frac{A(t_n - t_{n-1})k_n}{At_{en}k_n} \quad (17)$$

The expression (17) may be rewritten to the following numerical expression (18).

$$1 = \frac{(t_1 - t_0)}{t_{e1}} + \frac{(t_2 - t_1)}{t_{e2}} + \ldots + \frac{(t_n - t_{n-1})}{t_{en}} \quad (18)$$

$$t_0 = 0$$

Further, the expression (18) may be rewritten to the following numerical expression (19). In the expression (19), $\Delta t_i$ is a time of i-th factor period (a time from the start point to the end point in the period).

$$1 = \sum_{k=1}^{n} \frac{\Delta t_k}{t_{ek}} \quad (19)$$

$$\Delta t_i \equiv t_i - t_{i-1}$$

A term inside a sigma of a right side in the expression (19) is an expression about k-th factor period calculating a ratio of the time of $\Delta t_k$ of k-th factor period to the lifetime $t_{ek}$ of the charging roller 40 in a case maintaining the environment temperature $T_k$ (the absolute temperature) and the environment humidity $RH_k$ (the relative humidity) in the period constant. The expression (19) indicates that the charging roller 40 reaches the life when an addition value of the calculated results of the term in the sigma of the right side reaches 1.

That is, the term in the sigma of the right side in the expression (19) is an expression calculating a life consumption degree for each factor period. The life consumption degree $y_k$ in k-th factor period may be calculated by applying the environment temperature $T_k$ (the absolute temperature) and the environment humidity $RH_k$ (the relative humidity) in the k-th factor period into the following numerical expression (20).

$$x = \frac{\alpha}{T_k} + \frac{\beta}{RH_k} + \gamma \quad (20)$$

$$y_k = \frac{\Delta t_k}{\exp(x)}$$

The expression (20) is a model formula calculating a reduction rate (a reduction degree) of the substance amount of the charging roller 40 per the time $\Delta t_k$ in a case where the charging roller 40 is used for a period of the time $\Delta t_k$ under an environment where the temperature and the humidity are constant. The life consumption degree $y_k$ in the expression (20) (the model formula) is one example of the life consumption degree normalized with assuming the life to be 1. The life consumption degree $y_k$ may be called as a life consumption rate.

The MPU 81 may calculate the life consumption degree for each factor period and add up the life consumption degrees in order, and then, output the warning at a time when the addition value exceeds a predetermined threshold value. Thereby, it is possible to output the warning before the using time of the charging roller 40 reaches the lifetime varying according to the environment temperature and the environment humidity. Incidentally, if the life consumption degree normalized with assuming the life to be 1 is applied, the threshold value is less than 1.

Figure 4:
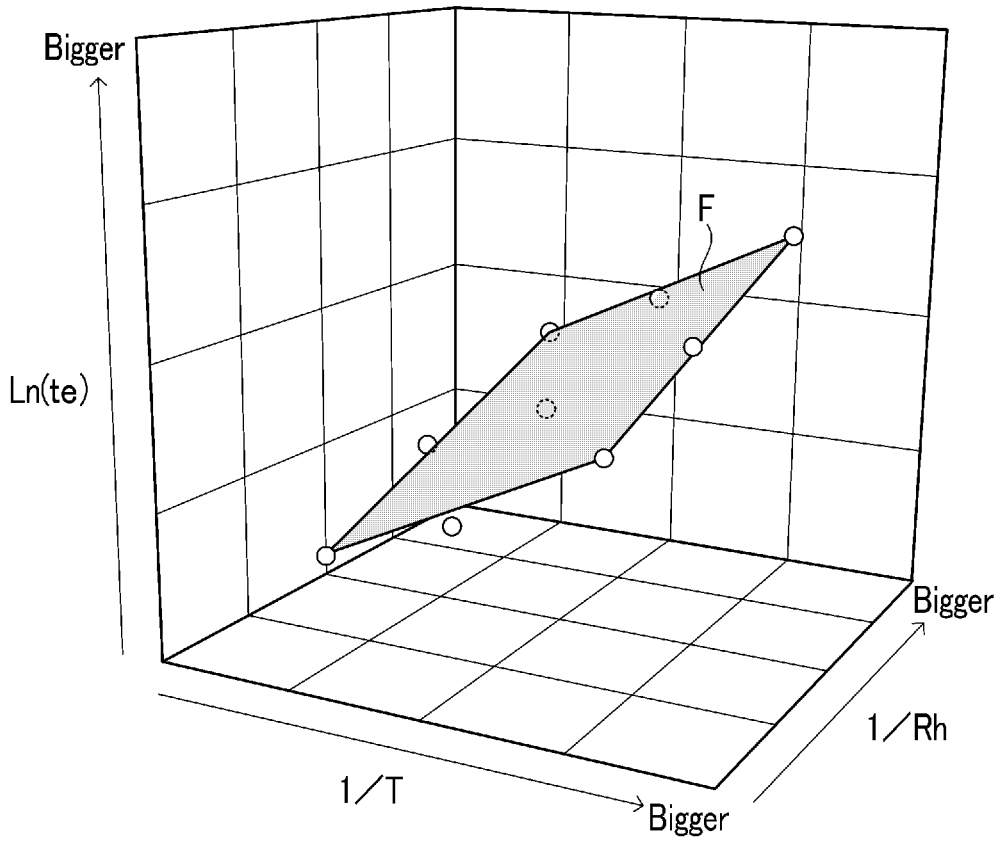
FIG. 4 is a graph plotting relationship of a lifetime of the charging roller with temperature and humidity.

In order to calculate the life consumption degree $y_k$, it is necessary to experimentally clarify in advance the constants α, β, γ in the expression (20). FIG. 4 is a three dimensional graph plotting nine experimental results of measurement of the lifetime of the charging roller 40 respectively under nine experiment condition with different temperature conditions and humidity conditions.

The nine experiment conditions are different combinations of any one of three temperature conditions of the environment temperatures T of 293.15K, 313.15K and 333.15K and any one of three humidity conditions of the environment humidities RH of 65%, 80% and 95%. In each experiment, the lifetime $t_e$ of the charging roller 40 is an elapsed time from an experiment start to a time when a white spot is caused in the image obtained by image forming process executed for every time when a constant time elapses. The white spot is a noise image appeared in an outputted half-tone image due to advance of the corrosion of the charging roller 40.

In FIG. 4, parameters of three axes are the reciprocal of the environment temperature T, the reciprocal of the environment humidity RH and natural logarithm of the lifetime $t_e$. As shown in FIG. 4, a primary linear polynomial expression having two variables of the reciprocal of the environment temperature T and the reciprocal of the environment humidity RH, i.e. an expression indicating one plane F having two variables of the reciprocal of the environment temperature T and the reciprocal of the environment humidity RH is an approximate expression calculating the natural logarithm of the lifetime $t_e$.

Therefore, from the above-mentioned experimental results, it is understandable that life estimation of the charging roller 40 on the basis of the expression (11) is effective. Incidentally, the expression indicating the plane F in FIG. 4 is a primary linear polynomial expression obtained applying the constants (α, β, γ=8300.33, 647.49, −28.70) into the expression (11). These constants (8300.33, 647.49, −28.70) are values obtained by least-squares method.

<Charging Roller Life Warning Process>

In the following, with reference to a flow chart in FIG. 3, one example of the charging roller life warning process executed by the MPU 81 will be described. In the following description, S1, S2 . . . indicate identification codes of process procedures. Incidentally, processes described later are actualized by executing the programs stored in the memory 82 by the MPU 81.

Figure 3:
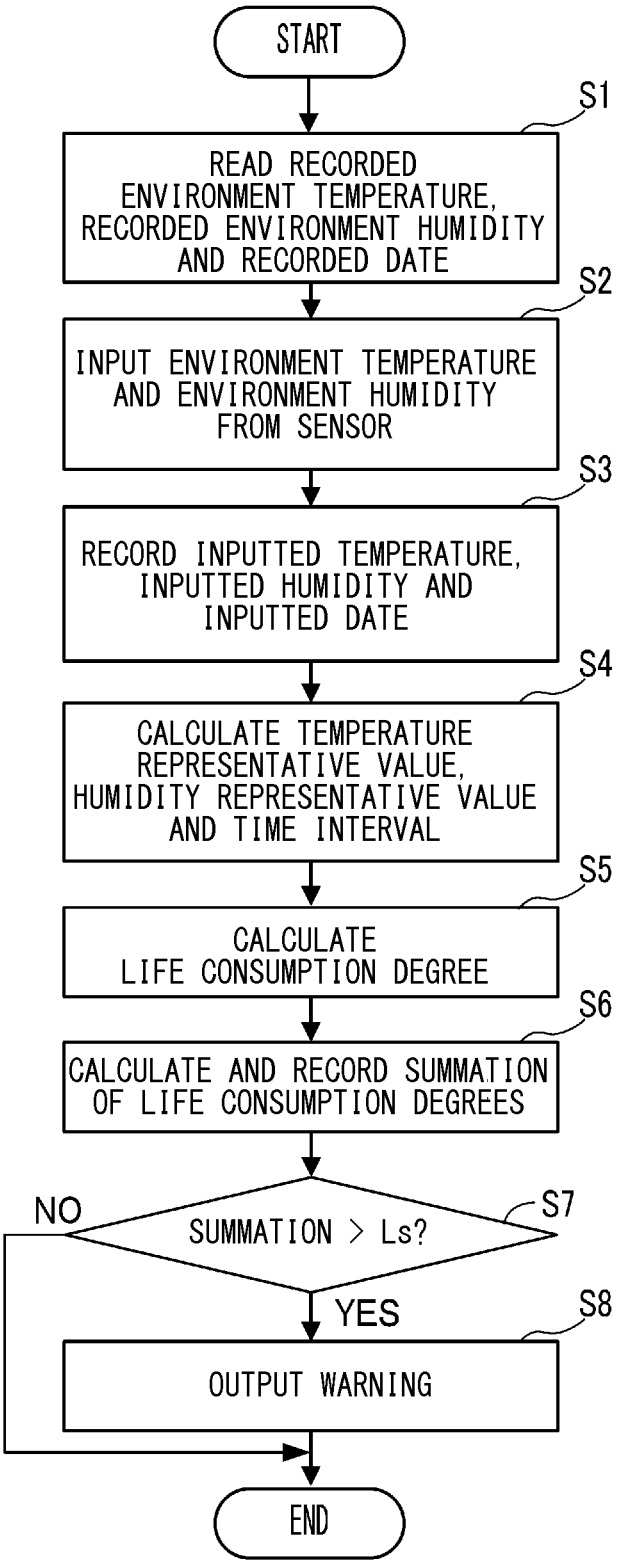
FIG. 3 is a flow chart of an example of a procedure of the process warning the life of the charging roller in the image forming apparatus according to the embodiment of the present disclosure.

The MPU 81 executes processes of steps S1-S7 shown in FIG. 3 at respective predetermined timings. For example, the MPU 81 executes the processes of the steps S1-S7 at the timings, such as starting, generation and termination of image forming job, and elapse of a predetermined time after the starting.

Firstly, at the step S1, the MPU 81 reads measurement data D1, which contains information of the environment temperature and the environment humidity and information of date when they are recorded, recorded in the memory 82 in last process. The measurement data D1 is data recorded in the memory 82 by the MPU 81 at the step S3 described later.

The environment temperature and the environment humidity contained in the data D1 read by the MPU 81 in the step S1 are respectively called as last environment temperature and last environment humidity. In addition, the date contained in the data D1 read by the MPU 81 in the step S1 is called as last measured date. As described later, the last measured date is date when the MPU 81 inputs the last environment temperature and the last environment humidity from the temperature sensor 801 and the humidity sensor 802.

Subsequently, at the step S2, the MPU 81 inputs the environment temperature and the environment humidity from the temperature sensor 801 and the humidity sensor 802. In the step S2, the environment temperature and the environment humidity inputted in the MPU 81 are respectively called as present environment temperature and present environment humidity. In addition, in the step S2, the date when the MPU 81 inputs the present environment temperature and the present environment humidity is called as present measured date.

Incidentally, the process in the step S2 is temperature and humidity inputting process inputting detected temperature of the temperature sensor 801 and detected humidity of the humidity sensor 802 at a predetermined timing. The steps S1, S2 are one example of a sampling step actualized by executing a sampling program Pr1 by the MPU 81. The MPU 81 executing the sampling program Pr1 is one example of a sampling part executing the temperature and humidity inputting process.

Subsequently, at the step S3, the MPU 81 records the measurement data D1, which contains the information of the present environment temperature and the present environment humidity inputted in the step S2 and the information of the present measured date, in the memory 82. The here recorded measurement data D1 is read by the MPU 81 in the step S1 in next process as the data containing the last environment temperature, the last environment humidity and the last measured date.

Incidentally, there may be a case where the measurement data D1 is not yet recorded in the memory 82 at the step S1, i.e. a case where the steps S1-S3 are executed at first. In this case, for example, the following processes may be executed under assuming the present environment temperature, the present environment humidity and the present measured date are respectively equal to the last environment temperature, the last environment humidity and the last measured date. Alternatively, in the case where the measurement data D1 is not yet recorded in the memory 82 in the step S1, the following steps S4-S8 may be skipped.

Subsequently, at the step S4, the MPU 81 calculates a temperature representative value as a representative value of the present environment temperature and the last environment temperature and a humidity representative value as a representative value of the present environment humidity and the last environment humidity. Further, the MPU 81 calculates a time interval between the present measured date and the last measured date. The representative value is, for example, an average value, such as a weighted average value, a maximum value or a minimum value. If the representative value is the average value, the representative value suitably reflected to the last and present temperature and humidity may be obtained.

And then, at the step S5, the MPU 81 calculates the life consumption degree of the charging roller 40 per the time interval by applying the temperature representative value and the humidity representative value into a predetermined model formula for example, such as the expression (20). If the model formula is the expression (20), the temperature representative value, the humidity representative value and the time interval are respectively substituted for the environment temperature $T_k$ (absolute temperature), the environment humidity $RH_k$ (relative humidity) and the time $\Delta t_k$ in the expression (20). Thereby, the life consumption degree $y_k$ for each factor period is calculated.

The expression (20) (the model formula) is an expression deriving larger life consumption degree $y_k$ in a case where the temperature representative value (the representative value of the detected temperature) and the humidity representative value (the representative value of the detected humidity) are respectively larger, as compared with a case where they are smaller.

More concretely, the expression (20) (the model formula) is an expression deriving a ratio of the time interval $\Delta t_k$ to a derived value of an exponential function having an exponent of a derived value x of a primary linear polynomial expression having two variables of the reciprocal of the environment temperature $T_k$ and the reciprocal of the environment humidity $RH_k$. Here, the time interval $\Delta t_k$ is a time from a last executing point to a present executing point in the temperature and humidity inputting process (S1). Calculating process of the life consumption degree $y_k$ in such a model formula has a very small operating load.

That is, in the steps S4, S5, the MPU 81 applies the respective representative values of the last and present inputted environment temperature (the detected temperature) and environment humidity (the detected humidity) into the predetermined model formula every time the temperature and humidity inputting process (S1) is executed. Thereby, the MPU 81 calculates the life consumption degree $y_k$ of the charging roller 40 per a period from the last executing point to the present executing point in the temperature and humidity inputting process (S1).

The steps S4, S5 are one example of a life consumption degree calculating step actualized by executing a life consumption degree calculating program Pr2 by the MPU 81. The MPU 81 executing the life consumption degree calculating program Pr2 is one example of a life consumption degree calculating part executing the process calculating the life consumption degree $y_k$. The process calculating the life consumption degree $y_k$ is one example of the life consumption degree of the charging roller 40 per the period from the last executing point to the present executing point in the temperature and humidity inputting process.

Subsequently, at the step S6, the MPU 81 calculates an addition value of the life consumption degrees $y_k$ and records addition value data D2 containing information of the addition value in the memory 82. More concretely, the MPU 81 reads the data D2 recorded in the memory 82 in the last process and adds up the life consumption degree calculated at present to the addition value of the life consumption degrees contained in the addition value data D2. Incidentally, an initial value of the addition value of the life consumption degrees is 0.

And then, at the step S7, the MPU 81 decides whether or not the addition value of the life consumption degrees $y_k$ satisfies a predetermined warning condition. For example, the warning condition is exceeding of the addition value of the life consumption degrees $y_k$ over a predetermined threshold value $L_s$. Such a warning condition is simple and is easily decided. If the life consumption degree $y_k$ normalized with assuming the life to be 1 is applied, the threshold value is a value relatively closer to "1", but is a value less than "1".

If the addition value of the life consumption degrees $y_k$ does not satisfy the warning condition, the present charging roller life warning process is finished (step S7: NO).

On the other hand, if the addition value of the life consumption degrees $y_k$ satisfies the warning condition, the process is shifted to the step S8 and the MPU 81 outputs the warning, thereby the present charging roller life warning process is finished.

For example, the MPU 81 outputs a warning message, which urges maintenance, such as replacement, of the charging roller 40, to the operating/displaying part 80. Alternatively, that the MPU 81 may output warning sound by a speaker (not shown) together with the warning message or in place of the warning message.

The steps S6-S8 are one example of a warning processing step actualized by executing a warning processing program Pr3 by the MPU 81. The MPU 81 executing the warning processing program Pr3 is one example of a warning processing part outputting the warning in a case where the addition value of the life consumption degrees $y_k$ satisfies the warning condition.

As described above, because the temperature and the humidity in the environment of the charging roller 40 is not constant, the lifetime of the charging roller 40 is varied. In such a case, the image forming apparatus 10 can outputs the warning at a suitable timing before the using time of the charging roller 40 reaches the lifetime, i.e. before the corrosion of the core metal part 401 causes the bad influence on the image quality.

APPLICATION EXAMPLES

The warning condition used in the step S7 may be a logical sum condition based on a plurality of conditions. For example, the warning condition may be the logical sum of following first condition and second condition. The first condition is exceeding of the addition value of the life consumption degrees $y_k$ over the threshold value $L_s$. The second condition is exceeding of the addition value of the life consumption degrees $y_k$ over a second threshold value smaller than the threshold value $L_s$ and exceeding of a change rate of the addition value of the life consumption degrees $y_k$ over a predetermined third threshold value.

In the step S5, a different expression from the expression (20) may be applied as the model formula. For example, the model formula may be derived from the experimental results shown in FIG. 4 by a well-known data mining manner.

Incidentally, the image forming apparatus and the method of warning a life of a charging roller according to the present disclosure may be configured by combining the embodiment and the application examples described above within the disclosure defined in the claims or by suitably deforming or partly omitting the embodiment and the application examples.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a charging roller electrically charging an image carrier;

a temperature sensor detecting temperature in an environment of the charging roller;

a humidity sensor detecting humidity in the environment of the charging roller; and a processor, wherein the processor is configured so as to execute:

a sampling part executing temperature and humidity inputting process inputting detected temperature of the temperature sensor and detected humidity of the humidity sensor at a predetermined timing;

a life consumption degree calculating part calculating a life consumption degree of the charging roller per a period from a last executing point to a present executing point in the temperature and humidity inputting process by applying respective representative values of last and present inputted detected temperature and detected humidity into a predetermined model formula every time the temperature and humidity inputting process is executed; and a warning processing part outputting a warning in a case where an addition value of the life consumption degrees exceeds a predetermined threshold value, wherein the life consumption degree calculating part uses, as the model formula, an expression deriving larger life consumption degree in a case where the representative value of the detected temperature and the representative value of the detected humidity are respectively larger, as compared with a case where they are smaller.

2. The image forming apparatus according to claim 1, wherein the life consumption degree calculating part uses, as the model formula, an expression deriving a ratio of a time to a derived value of an exponential function, in which the time is from the last executing point to the present executing point in the temperature and humidity inputting process, and the exponential function has an exponent of a derived value of a primary linear polynomial expression having two variables of the reciprocal of the representative value of the detected temperature and the representative value of the detected humidity.

3. The image forming apparatus according to claim 1, wherein the life consumption degree calculating part uses an average value as the respective representative values of the detected temperature and the detected humidity.

4. The image forming apparatus according to claim 1, wherein the life consumption degree calculating part calculates the life consumption degree by calculating a reduction rate of a substance amount of the charging roller per a period from the last executing point to the present executing point in the temperature and humidity inputting process.

5. The image forming apparatus according to claim 4, wherein the life consumption degree calculating part calculates the reduction rate of the substance amount of the charging roller on the basis of proportion of a reducing speed of the substance amount due to a chemical reaction to n-th power of the substance amount before the chemical reaction.

6. The image forming apparatus according to claim 1, wherein the life consumption degree calculating part calculates the life consumption degree $y_k$ per period $\Delta t_k$, by using formulas: $x=(\alpha/T_k)+(\beta/RH_k)+\gamma$; and $y_k=\Delta t_k/\exp(x)$, as the model formula using: the representative value $T_k$ of the detected temperature; the representative $RH_k$ value of the detected humidity; the derived value x of the exponential function; and constants $\alpha$, $\beta$, $\gamma$.

7. A method of warning a life of a charging roller in an image forming apparatus including a charging roller electrically charging an image carrier, comprising:

a sampling step executed by a processor included in the image forming apparatus to execute temperature and humidity inputting process inputting detected temperature and detected humidity in an environment of the charging roller at a predetermined timing;

a life consumption degree calculating step executed by the processor to calculate a life consumption degree of the charging roller per a period from a last executing point to a present executing point in the temperature and humidity inputting process by applying respective representative values of last and present inputted detected temperature and detected humidity into a predetermined model formula every time the temperature and humidity inputting process is executed; and a warning processing step executed by the processor to output a warning in a case where an addition value of the life consumption degrees exceeds a predetermined threshold value, wherein the life consumption degree calculating step uses, as the model formula, an expression deriving larger life consumption degree in a case where the representative value of the detected temperature and the representative value of the detected humidity are respectively larger, as compared with a case where they are smaller.

8. The method of warning the life of the charging roller according to claim 7, wherein the life consumption degree calculating step uses, as the model formula, an expression deriving a ratio of a time to a derived value of an exponential function, in which the time is from the last executing point to the present executing point in the temperature and humidity inputting process, and the exponential function has an exponent of a derived value of a primary linear polynomial expression having two variables of the reciprocal of the representative value of the detected temperature and the representative value of the detected humidity.

9. The method of warning the life of the charging roller according to claim 8, wherein the life consumption degree calculating step calculates the life consumption degree $y_k$ per period $\Delta t_k$, by using formulas: $x=(\alpha/T_k)+(\beta/RH_k)+\gamma$; and $y_k=\Delta t_k/\exp(x)$, as the model formula using: the representative value $T_k$ of the detected temperature; the representative $RH_k$ value of the detected humidity; the derived value x of the exponential function; and constants $\alpha$, $\beta$, $\gamma$.

* * * * *